US009213272B2

(12) United States Patent
Ichihashi et al.

(10) Patent No.: US 9,213,272 B2
(45) Date of Patent: Dec. 15, 2015

(54) IMAGE FORMING APPARATUS INCLUDING A HOLDING MEMBER TO HOLD A ROLLER RELATIVE TO A FRAME

(71) Applicants: Osamu Ichihashi, Kanagawa (JP); Yasufumi Takahashi, Tokyo (JP); Junpei Fujita, Kanagawa (JP)

(72) Inventors: Osamu Ichihashi, Kanagawa (JP); Yasufumi Takahashi, Tokyo (JP); Junpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 13/644,471

(22) Filed: Oct. 4, 2012

(65) Prior Publication Data

US 2013/0114982 A1 May 9, 2013

(30) Foreign Application Priority Data

Nov. 8, 2011 (JP) ..... 2011-244302
Aug. 16, 2012 (JP) ..... 2012-180688

(51) Int. Cl.
*G03G 15/14* (2006.01)
*G03G 15/16* (2006.01)
*G03G 15/01* (2006.01)

(52) U.S. Cl.
CPC ..... *G03G 15/1615* (2013.01); *G03G 15/0131* (2013.01); *G03G 15/0189* (2013.01); *G03G 2215/0158* (2013.01)

(58) Field of Classification Search
CPC ..... G03G 15/0189; G03G 15/1615; G03G 15/0131; G03G 2215/0158
USPC ..... 399/302, 82, 85, 121, 297, 300
See application file for complete search history.

(56) References Cited

U.S. PATENT DOCUMENTS

2005/0244197 A1* 11/2005 Sasamoto et al. ..... 399/299
2007/0196141 A1* 8/2007 Kitagawa et al. ..... 399/302
2008/0181670 A1 7/2008 Tsuda et al.

(Continued)

FOREIGN PATENT DOCUMENTS

JP 2001-005344 1/2001
JP 2004-053819 2/2004
JP 2009-294312 12/2009

OTHER PUBLICATIONS

U.S. Appl. No. 13/477,724, filed May 22, 2012, Yasunobu Shimizu, et al.

(Continued)

*Primary Examiner* — Benjamin Schmitt
*Assistant Examiner* — Matthew Miller
(74) *Attorney, Agent, or Firm* — Oblon, McClelland, Maier & Neustadt, L.L.P.

(57) ABSTRACT

An image forming apparatus includes multiple image bearing members, toner image forming devices, and a transfer unit. The transfer unit includes an intermediate transfer belt entrained about a plurality of rollers and onto which toner images are transferred from the image bearing members, a reference member to position the transfer unit in place, a frame to hold the plurality of rollers a certain distance from the reference member, and a moving device including a holding member to hold movably one of the rollers relative to the frame to change the position of the roller between a multiple color mode for forming a multiple color image and a single color mode for forming a single color image so that the intermediate transfer belt contacts and separates from the image bearing member. As the holding member contacts the reference member, the intermediate transfer belt contacts the image bearing members.

15 Claims, 5 Drawing Sheets

(56) References Cited

U.S. PATENT DOCUMENTS

| | | | | |
|---|---|---|---|---|
| 2009/0226221 | A1 | 9/2009 | Takahashi | |
| 2009/0279927 | A1 | 11/2009 | Fujita | |
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2010/0239333 | A1* | 9/2010 | Saito | 399/302 |
| 2010/0272478 | A1 | 10/2010 | Ichihashi | |
| 2011/0020017 | A1 | 1/2011 | Takahashi | |
| 2011/0058858 | A1 | 3/2011 | Fukuda et al. | |
| 2011/0064487 | A1* | 3/2011 | Ichihashi et al. | 399/302 |
| 2011/0158690 | A1 | 6/2011 | Mimbu et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0121293 | A1 | 5/2012 | Mimbu et al. | |
| 2012/0141169 | A1 | 6/2012 | Yamane et al. | |
| 2012/0148312 | A1 | 6/2012 | Takahashi | |
| 2012/0224879 | A1 | 9/2012 | Fujita et al. | |
| 2012/0230735 | A1 | 9/2012 | Uchitani et al. | |
| 2012/0237260 | A1 | 9/2012 | Sengoku et al. | |

OTHER PUBLICATIONS

U.S. Appl. No. 13/485,151, filed May 31, 2012, Yasunobu Shimizu, et al.
U.S. Appl. No. 13/483,536, filed May 30, 2012, Kenji Sengoku, et al.
U.S. Appl. No. 13/530,555, filed Jun. 22, 2012, Tomokazu Takeuchi, et al.
U.S. Appl. No. 13/526,894, filed Jun. 19, 2012, Tomokazu Takeuchi, et al.
U.S. Appl. No. 13/472,743, filed May 16, 2012, Junpei Fujita, et al.
U.S. Appl. No. 13/527,153, filed Jun. 19, 2012, Junpei Fujita, et al.

* cited by examiner

IMAGE FORMING APPARATUS INCLUDING A HOLDING MEMBER TO HOLD A ROLLER RELATIVE TO A FRAME

CROSS-REFERENCE TO RELATED APPLICATIONS

This patent application is based on and claims priority pursuant to 35 U.S.C. §119 from Japanese Patent Application Nos. 2011-244302, filed on Nov. 8, 2011, and 2012-180688, filed on Aug. 16, 2012, both in the Japan Patent Office, which are hereby incorporated herein by reference in their entirety.

BACKGROUND OF THE INVENTION

1. Field of the Invention

Exemplary aspects of the present disclosure generally relate to an image forming apparatus, such as a copier, a facsimile machine, a printer, or a multi-functional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

There is known a tandem-type color image forming apparatus in which a plurality of photosensitive members are arranged in tandem facing an intermediate transfer belt of a transfer unit entrained around and stretched taut between a plurality of rollers. In such an image forming apparatus, toner images of different colors are formed on each of the photosensitive members and transferred onto the intermediate transfer belt such that they are superimposed one atop the other, forming a composite toner image in a process known as a primary transfer process. Subsequently, the composite toner image is transferred onto a recording medium such as paper in a process known as a secondary transfer process.

Such a known tandem-type image forming apparatus has multiple printing modes, for example, a single color or monochrome mode using one photosensitive member for forming a single color image and a multiple color mode using a plurality of photosensitive members for forming a color image, and these modes are variable. In this configuration, during the single color mode, the photosensitive members that are not used are separated from the intermediate transfer belt to prevent deterioration of the photosensitive drums and the intermediate transfer belt.

In one example of a known separation technique employed in the tandem-type image forming apparatus, the intermediate transfer belt is stretched taut linearly between two belt support rollers, one of which disposed at the photosensitive member side not to be used is held movably by a holder. A rod of a solenoid contacts the holder. The rod projecting from the solenoid contacts the holder to position the belt support roller at its contact position at which the intermediate transfer belt contacts the photosensitive drum. In a case in which the rod contacts the holder while the rod does not project from the solenoid, the roller is at its separating position at which the intermediate transfer belt is separated from the photosensitive drum.

In another approach, primary transfer rollers are disposed each facing the photosensitive members via the intermediate transfer belt, and the primary transfer rollers facing the photosensitive members not to be used are movably held by a holder, and the holder contacts a cam. As the position of the cam changes, the primary transfer rollers take either the contact position or the separating position.

According to the known approaches described above, generally, a frame member holds the belt support rollers and the primary transfer rollers, and is disposed both at a proximal side and a distal side in the axial direction of the rollers. Furthermore, the transfer unit is positioned in place in the image forming apparatus by using a reference member provided at a reference position of the frame member. The frame member rotatably holds the belt support rollers and the primary transfer rollers at a position a certain distance from the reference position.

However, in reality, the frame member of the transfer unit itself has a tolerance, and the rollers such as the belt support rollers and the primary transfer rollers have a mounting tolerance or the like relative to the frame member so that the positional accuracy of the rollers depends on these tolerances.

The solenoid and the cam described above are mounted at a position a certain distance from the reference position of the frame member. As a result, the solenoid and the cam also have a mounting tolerance. In such a configuration, parallelism between the roller to be separated and the roller not to be separated is difficult to achieve because the mounting tolerance of the solenoid and the cam are added to the tolerance of the frame member itself and the mounting tolerance of the roller to be separated and the roller not to be separated. Consequently, the intermediate transfer belt moves improperly or shifts easily.

Of course, when using a solenoid and a cam, parts required for mounting the solenoid and the cam are required, hence increasing the number of parts and complicating efforts to achieve desirable positional accuracy of the rollers to be moved. As a result, the tension of the intermediate transfer belt is difficult to stabilize, and the moving speed of the intermediate transfer belt fluctuates easily. Fluctuation of the moving speed of the intermediate transfer belt results in unevenness of image density, and color drift occurs in an output image in the multiple color mode.

In view of the above, there is demand for an image forming apparatus that can prevent improper movement and fluctuation of the intermediate transfer belt when moving the intermediate transfer belt in multiple color mode and the single color mode.

BRIEF SUMMARY OF THE INVENTION

In view of the foregoing, in an aspect of this disclosure, there is provided an improved image forming apparatus including a plurality of image bearing members, a plurality of toner image forming devices, and a transfer unit. The plurality of image bearing members bears toner images of different colors on a surface thereof. The plurality of toner image forming devices forms the toner images on the surface of the plurality of image bearing members. The transfer unit includes an intermediate transfer belt and transfers the toner images on the surface of the plurality of image bearing members onto the intermediate transfer belt. The transfer unit includes a plurality of rollers, the intermediate transfer belt, a reference member, a frame, and a moving device. The intermediate transfer belt is disposed facing the plurality of image bearing members, entrained about the plurality of rollers, and formed into a loop. The reference member positions the transfer unit in place. The frame holds the plurality of rollers a certain distance from the reference member. The moving device includes a holding member to hold movably one of the rollers relative to the frame to change the position of the roller between a multiple color mode for forming a multiple color image and a single color mode for forming a single color image so that the intermediate transfer belt contacts and separates from the image bearing member. As the holding member contacts the reference member, the intermediate transfer belt contacts the image bearing members.

According to another aspect, an image forming apparatus includes a plurality of image bearing members, a plurality of toner image forming devices, and a transfer unit. The plurality of image bearing members bears toner images of different colors on a surface thereof. The plurality of toner image forming devices forms the toner images on the surface of the plurality of image bearing members. The transfer unit includes an intermediate transfer belt and transfers the toner images on the surface of the plurality of image bearing members onto the intermediate transfer belt. The transfer unit includes a plurality of rollers, the intermediate transfer belt, a reference member, a frame, and a moving device. The intermediate transfer belt is disposed facing the plurality of image bearing members, entrained about the plurality of rollers, and formed into a loop. The reference member positions the transfer unit in place. The frame holds the plurality of rollers a certain distance from the reference member. The moving device includes a holding member to hold movably one of the rollers relative to the frame to change the position of the roller between a multiple color mode for forming a multiple color image and a single color mode for forming a single color image so that the intermediate transfer belt contacts and separates from the image bearing member. The holding member includes a first contact portion and a second contact portion. As the first contact portion of the holding member contacts the reference member, the roller moves to a first position such that the intermediate transfer belt contacts the image bearing member, and as the second portion of the holding member contacts the reference member, the roller moves to a second position such that the intermediate transfer belt separates from the image bearing member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
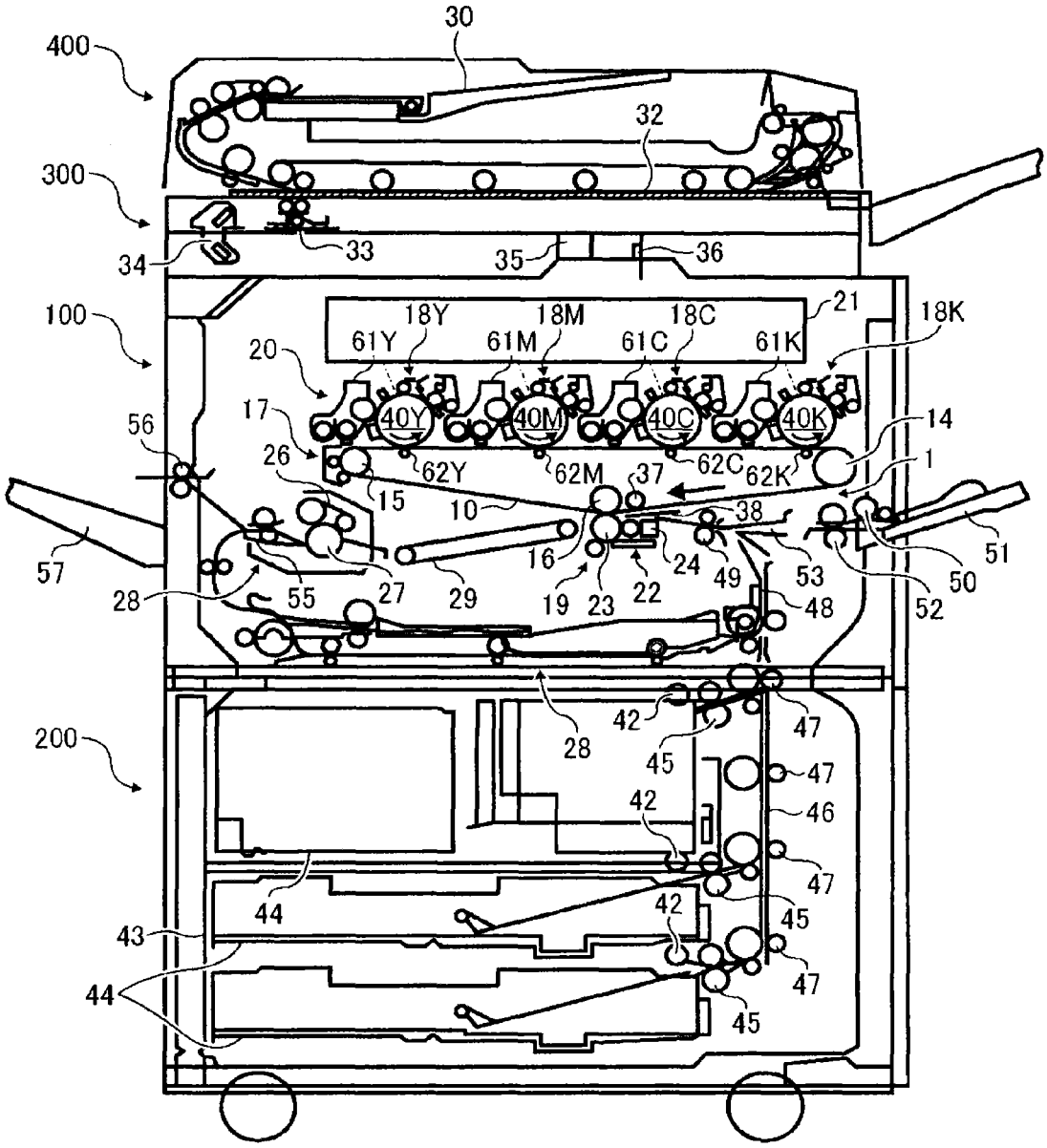
FIG. 1 is a schematic diagram illustrating an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating the image forming apparatus according to an illustrative embodiment of the present invention. The image forming apparatus includes a copier main body 100, a sheet feed unit 200 disposed below the copier main body 100, a scanner 300 disposed above the copier main body 100, and an automatic document feeder (hereinafter ADF) 400.

The scanner 300 includes a first carriage 33 equipped with a mirror and a light source for illuminating a document, a second carriage 34 equipped with a plurality of reflective mirrors, and a contact glass 32. As the first carriage 33 and the second carriage 34 move back and forth, the document placed on the contact glass 32 is read optically. Scan light from the second carriage 34 is focused onto an imaging surface of a read sensor 36 by a focusing lens 35. Subsequently, the light is read as an image signal by the read sensor 36. The read sensor 36 is disposed behind the focusing lens 35.

Image forming stations 18Y, 18M, 18C, and 18K (collectively referred to as image forming stations 18) include photosensitive drums 40Y, 40M, 40C, and 40K (collectively referred to as photosensitive drums 40) serving as latent image bearing members, one for each of the colors yellow, magenta, cyan, and black, respectively. More specifically, the photosensitive drums 40Y, 40M, 40C, and 40K bear toner images of yellow, magenta, cyan, and black, respectively. Various imaging devices such as a charger, a developing device, and a cleaning device for electrophotographic process are disposed around each of the photosensitive drums 40Y, 40M, 40C, and 40K, thereby constituting the image forming stations 18Y, 18M, 18C, and 18K.

The copier main body 100 includes a tandem-type image forming unit 20. The image forming unit 20 includes the image forming stations 18Y, 18M, 18C, and 18K. It is to be noted that suffixes Y, M, C, and K denote the colors yellow, magenta, cyan, and black, respectively. To simplify the description, these suffixes Y, M, C, and K indicating colors are omitted herein unless otherwise specified.

Developing devices 61Y, 61M, 61C, and 61K (collectively referred to as developing devices 61) of the image forming stations 18Y, 18M, 18C, and 18K employ developing agents consisting of toners of yellow, magenta, cyan, and black, respectively. The developing devices 61Y, 61M, 61C, and 61K are disposed facing the photosensitive drums 40Y, 40M, 40C, and 40K, respectively. The developing devices 61 include a developing agent bearing member that carries and supplies the developing agent to the latent images on the photosensitive drums 40.

An alternating electric filed is applied to the developing agent at a position opposite the photosensitive drums 40, thereby developing the latent images on the photosensitive drums 40 to form visible images known as toner images. By applying the alternating electric field, the developing agent is activated so that a distribution of electrical charge on toner is narrowed, enhancing development of the latent images. The developing devices 61 are held together with the photosensitive drums 40, thereby constituting process cartridges detachably attachable relative to the image forming apparatus. Each of the process cartridges may include the charger and the cleaning device.

An exposure device 21 is disposed above the image forming unit 20. The exposure device 21 illuminates the photosensitive drums 40 with laser light or LED light based on image information, thereby forming latent images on the photosensitive drums 40.

An intermediate transfer unit 1 is disposed below the photosensitive drums 40 of the image forming unit 20. The intermediate transfer unit 1 includes the intermediate transfer belt 10. The intermediate transfer belt 10 is formed into an endless loop, and entrained about and stretched taut between belt support rollers 14 through 16. Primary transfer rollers 62Y, 62M, 62C, and 62K (collectively referred to as primary transfer rollers 62) are disposed opposite the photosensitive members 40Y, 40M, 40C, and 40K via the intermediate transfer belt 10, respectively. The primary transfer rollers 62 transfer the toner images formed on the photosensitive members 40 onto the intermediate transfer belt 10 such that the toner images are superimposed one atop the other, thereby forming a composite toner image.

A cleaning device 17 is provided to the intermediate transfer belt 10 to remove residual toner remaining on the surface of the intermediate transfer belt 10 in preparation for the subsequent imaging cycle. The cleaning device 17 includes a cleaning blade made of a fur brush or urethane rubber. The cleaning blade contacts the intermediate transfer belt 10 to remove the residual toner adhering to the intermediate transfer belt 10 after a secondary transfer process.

A secondary transfer unit 19 is disposed substantially below the intermediate transfer belt 10. The secondary transfer unit 19 transfers the composite toner image on the intermediate transfer belt 10 onto a recording medium supplied from a sheet cassette 44 of the sheet feed unit 200. The secondary transfer unit 19 includes a secondary transfer roller 23. The secondary transfer roller 23 is pressed against the belt support roller 16 via the intermediate transfer belt 10, thereby transferring the composite toner image on the intermediate transfer belt 10 onto a recording medium. Thereafter, the belt support roller 16 is referred to as a secondary transfer auxiliary roller.

A sheet transport belt 29 is disposed near the secondary transfer unit 19 to transport a recording medium to a fixing device 28 downstream from the sheet transport belt 29. The fixing device 28 fixes the composite toner image on the recording medium with heat and pressure. The fixing device 28 includes a fixing belt 26 and a pressing roller 27. The fixing belt 26 is formed into an endless loop and pressed by the pressing roller 27. A sheet reversing unit is disposed below the secondary transfer unit 19 and the fixing device 28. The sheet reversing unit turns over the recording medium to form an image on both sides of the recording medium.

Next, a description is provided of image forming operation by the image forming apparatus according to an illustrative embodiment of the present invention.

When forming an image, a document is placed on a document table 30 of the ADF 400 or on the contact glass 32 of the scanner 300 by lifting up the ADF 400. In the latter case, the ADF 400 is closed after placing the document on the contact glass 32. If the document is placed on the document table 30 of the ADF 400 and a start button is pressed, the scanner 300 starts reading the document by moving the first carriage 33 and the second carriage 34 after the document is delivered onto the contact glass 32. If the document is placed directly onto the contact glass 32 and the star button is pressed, the scanner 300 immediately starts reading the document by moving the first carriage 33 and the second carriage 34. The light source of the first carriage 33 projects light against the document surface, which is then reflected on the document surface. The reflected light is reflected towards the second carriage 34.

Subsequently, the mirrors of the second carriage 34 reflect the light towards the focusing lens 35 which directs the light to the read sensor 36. Accordingly, the read sensor 36 reads optically the document. After reading the document, the image forming operation starts in either the multiple color mode or the monochrome mode selected at a control unit. In a case in which an automatic selection mode is set at the control unit, the image forming operation starts automatically in either the multiple color mode (full-color mode) or the monochrome mode based on the image information read by the read sensor 36.

As will be described in detail later with reference to FIG. 2, when forming an image in the multiple color mode, the intermediate transfer belt 10 contacts the photosensitive drums 40Y, 40M, 40C, and 40K. Toner images formed on the photosensitive drums 40Y, 40M, 40C, and 40K are transferred onto the intermediate transfer belt 10 such that they are superimposed one atop the other, thereby forming a composite toner image while the image forming stations 18Y, 18M, 18C, and 18K are driven. More specifically, a drive motor is driven to rotate one of the belt support rollers 14, 15, and 16 (secondary transfer auxiliary roller), and other two rollers serve as follower rollers. Accordingly, the intermediate transfer belt 10 is rotated. In the meantime, in each of the image forming stations 18Y, 18M, 18C, and 18K, the chargers charge uniformly the photosensitive drums 40Y, 40M, 40C, and 40K.

Subsequently, based on the image information read by the scanner 300, the exposure device 21 illuminates the charged photosensitive drums 40Y, 40M, 40C, and 40K with write light L projected from a light source such as a laser and an LED, thereby forming electrostatic latent images on the photosensitive drums 40Y, 40M, 40C, and 40K. Subsequently, the developing devices 61Y, 61M, 61C, and 61K supply the respective color of developing agents to the electrostatic latent images formed on the photosensitive drums 40Y, 40M, 40C, and 40K, one for each of the colors yellow, magenta, cyan and black, thereby forming visible images, known as toner images of yellow, magenta, cyan and black.

As described above, the toner images formed on the photosensitive drums 40Y, 40M, 40C, and 40K are transferred onto the intermediate transfer belt 10 by the primary transfer rollers 62Y, 62M, 62C, and 62K such that they are superimposed one atop the other, thereby forming the composite toner image in the process known as primary transfer. After the primary transfer, residual toner remaining on the surface of the photosensitive drums 40Y, 40M, 40C, and 40K is removed by a drum cleaning device. Residual charge on the photosensitive drums 40Y, 40M, 40C, and 40K is also removed by a charge eliminator in preparation for the subsequent imaging cycle.

As for sheet feeding operation, when a start button is pressed, one of the sheet cassettes 44 of a paper bank 43 in the sheet feed unit 200 is selected, and a sheet feed roller 42 of the respective sheet cassette 44 is rotated, thereby feeding a recording medium from a stack of recording media sheets stored in the sheet cassette 44. The paper bank 43 is equipped with multiple sheet cassettes 44, each storing a stack of recording media sheets.

A sheet separation roller 45 feeds the recording medium to a sheet path 46 of the sheet feed unit 200, one sheet at a time. Transport rollers 47 guide the recording medium to a downstream sheet path 48 and then to a pair of registration rollers 49 in the copier main body 100. When the recording medium contacts the registration rollers 49, rotation of the registration rollers 49 is halted temporarily.

In a case in which the recording medium is fed manually, a sheet feed roller 50 is rotated to pick up the recording medium placed on a manual feed tray 51 and sends it to a separation roller 52. The separation roller 52 then sends the recording medium to a manual feed path 53 in the copier main body 100, one sheet at a time. The recording medium is stopped temporarily by the pair of registration rollers 49. The pair of registration rollers 49 starts to rotate again to send the recording medium to a secondary transfer nip between the intermediate transfer belt 10 and the secondary transfer unit 19 in appropriate timing such that the recording medium is aligned with the composite toner image formed on the intermediate transfer belt 10.

After passing between the secondary transfer roller 23 and the intermediate transfer belt 10, the recording medium bearing the unfixed toner image is delivered to the fixing device 28 in which heat and pressure are applied to the unfixed toner image, thereby fixing the toner image on the recording medium. After the fixing process, the recording medium is directed to a sheet discharge roller 56 by a switching claw 55. The recording medium is output onto a sheet output tray 57, or the recording medium is directed to the sheet reversing unit by the switching claw 55 so that the recording medium is turned over and transported to the transfer position. Accordingly, the image is formed on the back of the recording medium.

Subsequently, the recording medium is output by the sheet discharge roller 56 onto the sheet output tray 57. After the transfer process, residual toner remaining on the intermediate transfer belt 10 is removed by the cleaning device 17 in preparation for the subsequent imaging cycle by the image forming unit 20.

As will be described in detail later with reference to FIG. 3, when forming an image in the monochrome mode, the intermediate transfer belt 10 is separated from the photosensitive drums 40Y, 40M, 40C so that the intermediate transfer belt 10 contacts only the photosensitive drum 40K. In this state, only the image forming station 18K is driven to form a toner image of black on the photosensitive drum 40K and transfer the black toner image onto the intermediate transfer belt 10. In the monochrome mode, the intermediate transfer belt 10 is separated from the photosensitive drums 40Y, 40M, and 40C, and the photosensitive drums 40Y, 40M, and 40C are not driven, thereby enhancing the useful life of the photosensitive drums 40Y, 40M, and 40C. Furthermore, this configuration enhances the useful life of the intermediate transfer belt 10, because the photosensitive drums 40Y, 40M, and 40C do not contact the intermediate transfer belt 10 in the monochrome mode.

Figure 2:
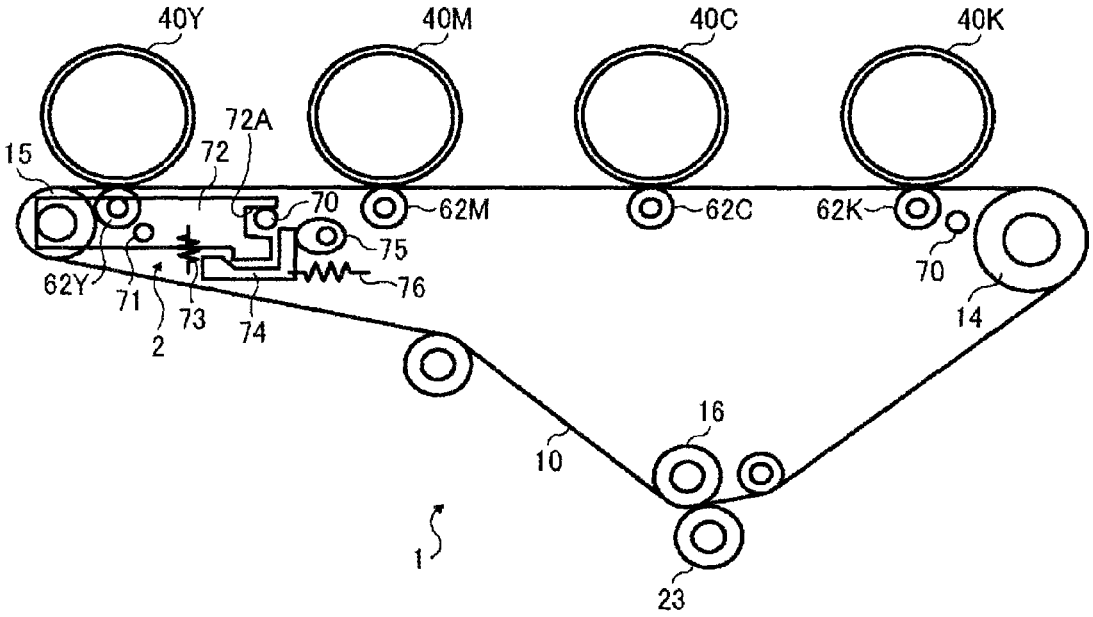
FIG. 2 is an enlarged view schematically illustrating an intermediate transfer unit of the image forming apparatus of FIG. 1 in a multiple color mode.
Figure 3:
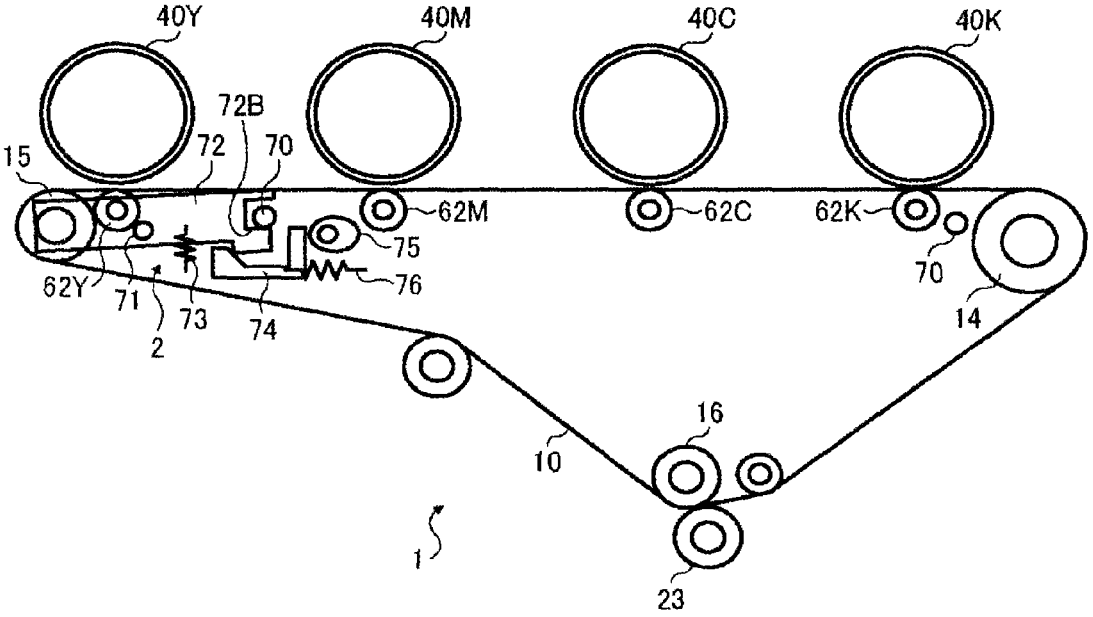
FIG. 3 is an enlarged view schematically illustrating the intermediate transfer unit in a single color or monochrome mode.
Figure 4:
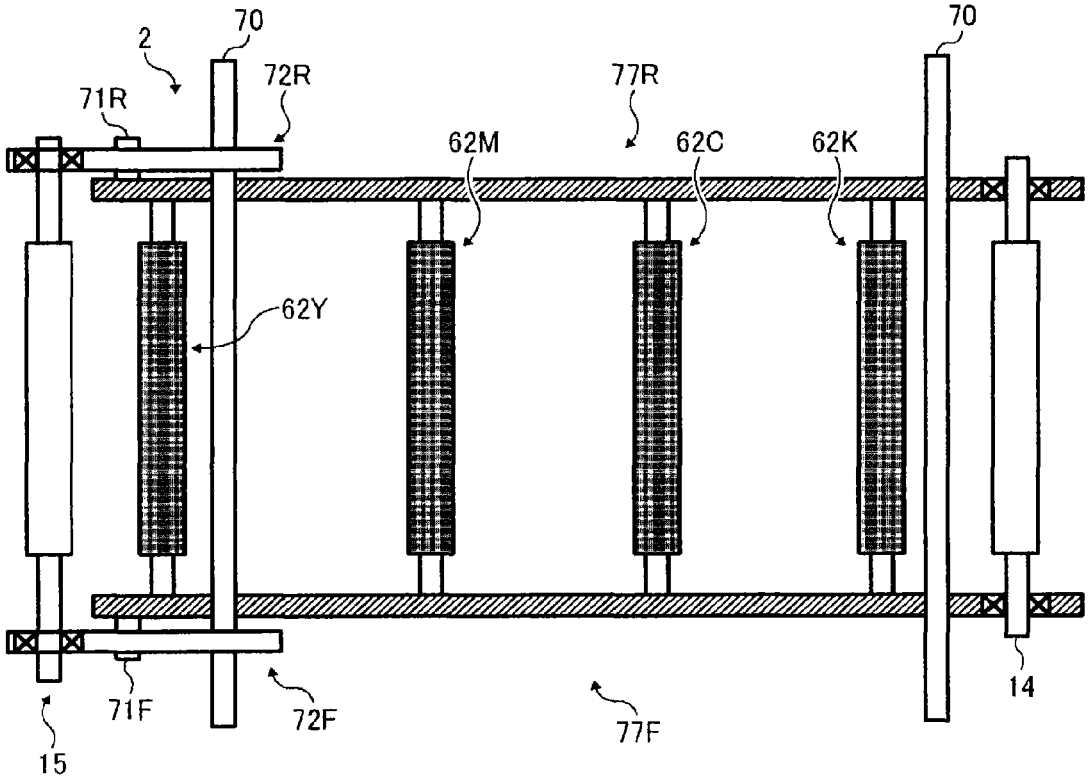
FIG. 4 is a top view schematically illustrating the inside of the intermediate transfer unit.

Next, with reference to FIGS. 2 through 4, a description is provided of a moving mechanism of the intermediate transfer belt 10 and the photosensitive drums 40Y, 40M, and 40C in the multiple color mode and the monochrome mode. FIG. 2 is an enlarged view schematically illustrating the intermediate transfer unit 1 of the image forming apparatus in the multiple color mode. FIG. 3 is an enlarged view schematically illustrating the intermediate transfer unit 1 in the monochrome mode. FIG. 4 is a top view schematically illustrating the inside of the intermediate transfer unit 1.

According to an illustrative embodiment of the present invention, in the intermediate transfer unit 1, the toner images are transferred from the photosensitive drums 40Y, 40M, 40C, and 40K onto the surface of the intermediate transfer belt 10 stretched taut between the belt support roller 15 and the belt support roller 14. This surface of the intermediate transfer belt 10 is referred to as a primary transfer surface. The position of the primary transfer surface of the intermediate transfer belt 10 in the multiple color mode changes in the monochrome mode. For example, during the multiple color mode, the primary transfer surface is at the position illustrated in FIG. 2. By contrast, during the monochrome mode, the primary transfer surface is at the position illustrated in FIG. 3.

According to the illustrative embodiment as illustrated in FIGS. 2 and 3, the intermediate transfer unit 1 includes a moving device 2 to move one of the belt support rollers 14 and 15, that is, the belt support roller 15 at the photosensitive drum 40Y side (at the left side in FIGS. 2 and 3), to change the position of the primary transfer surface of the intermediate transfer belt 10 relative to the photosensitive drums 40Y, 40M, and 40C.

As illustrated in FIG. 4, the intermediate transfer unit 1 includes frames 77F and 77R serving as frame members of the intermediate transfer unit 1. The frame 77F is disposed at a proximal side in FIG. 4. The frame 77R is disposed at a distal side in FIG. 4. The frames 77F and 77R include reference shafts 70 disposed at reference positions (for example, 2 locations) of the frame members 77F and 77R. The reference shafts 70 are fitted to reference portions of the image forming apparatus, thereby positioning the intermediate transfer unit 1 in place relative to the image forming apparatus.

According to the present illustrative embodiment, a roller shaft of one of the belt support rollers 14 and 15, that is, the belt support roller 14 at the photosensitive drum 40K side (at the right side in FIGS. 2 and 3), is rotatably supported at a position a certain distance from the reference positions of the frames 77F and 77R. With this configuration, the belt support roller 14 is positioned in place relative to the photosensitive drums 40Y, 40M, 40C, and 40K. The belt support roller 15 is movably supported relative to the frames 77F and 77R.

The shaft of the belt support roller 15 is movably held by holding members 72F and 72R (collectively referred to as holding members 72) which are rotatably supported by fulcrum shafts 71F and 71R. Accordingly, the shaft of the belt support roller 15 is supported at the frames 77F and 77R. The fulcrum shafts 71F and 71R, and the holding members 72F and 72R are disposed outside the frames 77F and 77R in the direction of the roller axis. The holding members 72F and 72R are disposed to contact the reference shaft 70 of the frames 77F and 77R.

As illustrated in FIGS. 2 and 3, a spring 73 is provided at the bottom of the holding members 72 (72F, 72R) that support the belt support roller 15. A sliding member 74 including a cam 75 is disposed substantially below the holding member 72. The sliding member 74 serves as a moving device for moving the holding member 72 and is biased against the cam 75 by a spring 76.

Figure 5:
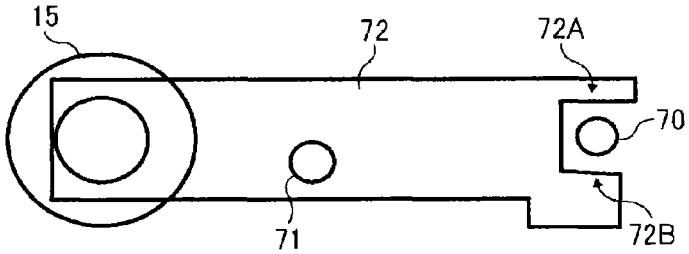
FIG. 5 is an enlarged view schematically illustrating a holding member holding a movable belt support roller of the intermediate transfer unit.

FIG. 5 illustrates an enlarged view schematically illustrating the holding member 72 (72F, 72R). As illustrated in FIG. 5, the holding member 72 includes a recessed portion substantially at an end thereof (at the right side in FIG. 5) opposite to the shaft of the belt support roller 15. The recessed portion of the holding member 72 has a sidewardly open U-shape and includes an upper contact surface 72A and a lower contact surface 72B of the recessed portion to contact the reference shaft 70.

During the multiple color mode as illustrated in FIG. 2, the holding member 72 is pulled down by the spring 73 so that the upper contact surface 72A of the recessed portion of the holding member 72 contacts the reference shaft 70. With this configuration, the belt support roller 15 supported at the opposite end of the holding member 72 is positioned such that the primary transfer surface of the intermediate transfer belt 10 contacts the photosensitive drums 40Y, 40M, 40C, and 40K. In this state, the sliding member 74 is separated from the holding member 72.

By contrast, when the monochrome mode is selected as illustrated in FIG. 3, the cam 75 is rotated by a drive transmission device, thereby moving the sliding member 74 to the right side in FIG. 3. As a result, the sliding member 74 contacts the bottom portion of the holding member 72. The spring 73 has a pressing force F pressing the holding member 72 in the clockwise direction, which is smaller than a pressing force F' of the spring 76 pressing the sliding member 74 against the holding member 72 in the counterclockwise direction (F<F'). Accordingly, the counterclockwise rotation of the holding member 72 causes the lower contact surface 72B to contact the reference shaft 70. With this configuration, the belt support roller 15 supported substantially at the opposed end of the holding member 72 with the recessed portion is positioned such that the primary transfer surface of the intermediate transfer belt 10 is separated from the photosensitive drums 40Y, 40M, and 40C.

It is to be noted that the shafts of the primary transfer rollers 62Y, 62M, 62C, and 62K are disposed opposite the photosensitive members 40Y, 40M, 40C, and 40K, and are movably held at predetermined positions of the frames 77F and 77R via springs or the like such that the primary transfer rollers 62Y, 62M, 62C, and 62K can contact and separate from the intermediate transfer belt 10. With this configuration, in accordance with changes in the position of the intermediate transfer belt 10 as illustrated in FIGS. 2 and 3, the primary transfer rollers 62Y, 62M, and 62C move, accordingly.

According to the illustrative embodiment as described above, the holding members 72F and 72R that hold the belt support roller 15 to be moved are positioned by contacting the reference shaft 70 which is used to position the intermediate transfer unit 1 relative to the image forming apparatus. With this configuration, accumulation of tolerance between the belt support rollers 15 and 14, and other rollers is less than the conventional configuration in which the holding member contacts the solenoid and the cam.

As a result, misalignment or twisting of rollers is suppressed, thereby achieving desirable parallelism of the rollers with ease and preventing shifting of the intermediate transfer belt 10.

According to the present embodiment, the number of parts, tolerance of which needs to be taken into consideration, is reduced, thereby minimizing an amount of deformation of parts. Thus, fluctuation of the moving speed of the intermediate transfer belt 10 due to displacement of the belt support roller 15 is suppressed, thereby preventing color drift and unevenness of image density.

As illustrated in FIG. 4, the reference shafts 70 are disposed in the same direction as or parallel to the axial direction of the belt support roller 15 to be moved and support the intermediate transfer unit 1 at both ends thereof relative to the image forming apparatus. Accordingly, parallelism in the axial direction is achieved effectively.

The contact portion of the holding members 72F and 72R that contacts the reference shaft 70 is disposed outside the frames 77F and 77R in the axial direction of the belt support roller 15. Since both ends of the reference shaft 70 are held, the center area of the shaft 70 flexes easily. Therefore, the belt support roller 15 is positioned reliably by the reference shaft 70 outside the frames 77F and 77R.

Figure 6:
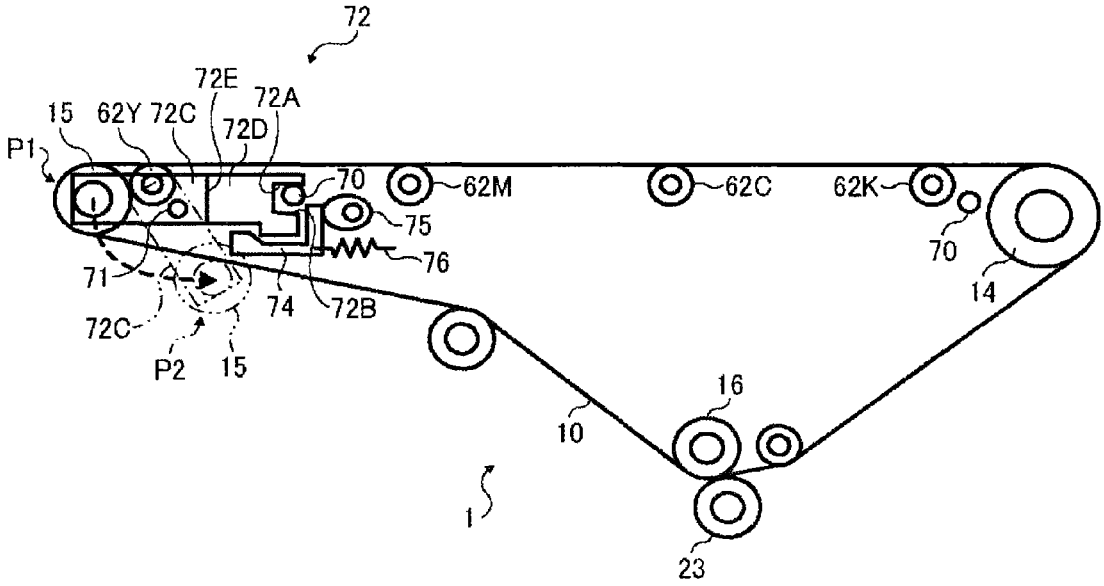
FIG. 6 is an enlarged view schematically illustrating the holding member according to another illustrative embodiment of the present invention.
Figure 7:
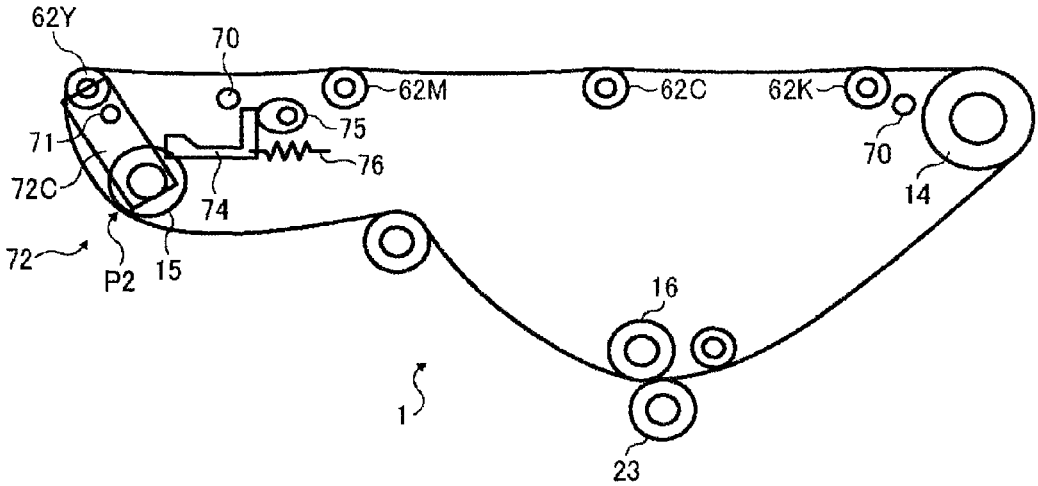
FIG. 7 is an enlarged view schematically illustrating the holding member of FIG. 6 from which a restriction member is removed therefrom.
Figure 8:
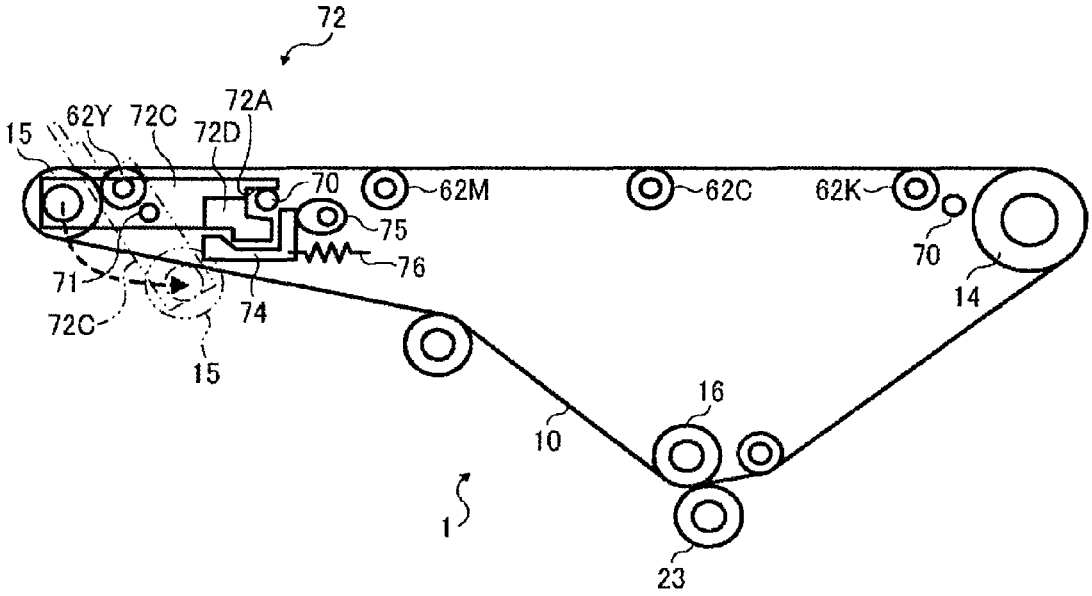
FIG. 8 is an enlarged view schematically illustrating another example of the holding member.
Figure 9:
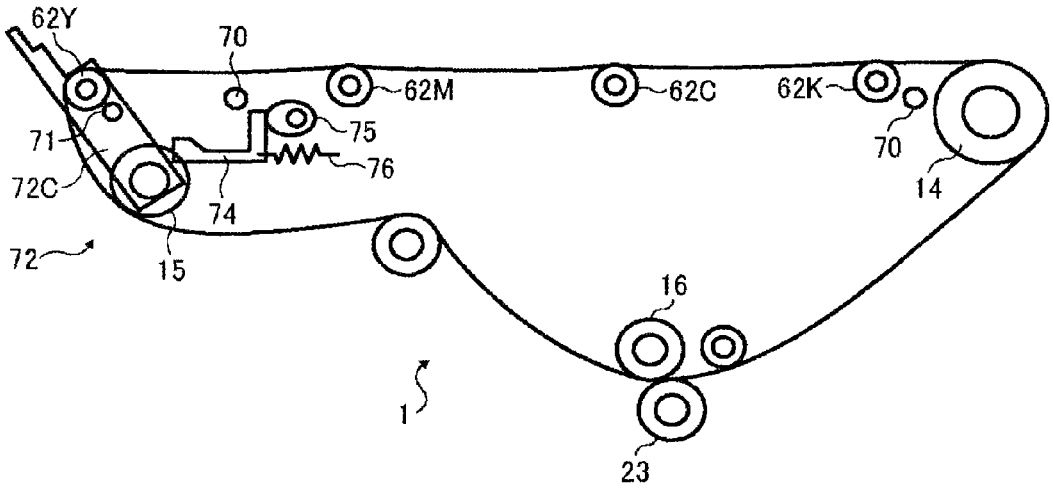
FIG. 9 is an enlarged view schematically illustrating the holding member of FIG. 8 from which the restriction member is removed therefrom.

With reference to FIGS. 6 through 9, a description is provided of variations of the holding member 72. FIG. 6 is an enlarged view schematically illustrating the intermediate transfer unit 1 in which the holding member 72 comprises two separable parts: a roller holder 72C and a restriction member 72D. FIG. 7 is an enlarged view schematically illustrating the intermediate transfer unit 1 in which the restriction member 72D is removed from the holding member 72. FIG. 8 is an enlarged view schematically illustrating another example of the holding member 72. FIG. 9 is an enlarged view schematically illustrating the holding member 72 of FIG. 8 from which the restriction member 72D is removed.

As illustrated in FIGS. 6 and 8, the holding member 72 includes the roller holder 72C and the restriction member 72D detachably attachable relative to the roller holder 72C. The roller holder 72C holds the belt support roller 15 and rotates. The restriction member 72D includes the contact portion or a portion of the contact portion to restrict movement of the holding member 72. Removal of the restriction member 72D from the roller holder 72C of the holding member 72 allows the roller holder 72C to rotate about the fulcrum shaft 71 without getting restricted by the restriction member 72D. Accordingly, rotation of the roller holder 72C about the fulcrum shaft 71 in the counterclockwise direction moves the belt support roller 15 from a position P1 to a position P2 at which the intermediate transfer belt 10 is not stretched but retains slack so that the intermediate transfer belt 10 can be detached from and attached to the intermediate transfer unit 1 in the axial direction of the belt support roller 15.

As described above, by moving the belt support roller 15, the intermediate transfer belt 10 can be replaced with ease, thus significantly reducing a total required time for replacement of the intermediate transfer belt 10, as compared with a configuration in which the position of the belt support roller is not changeable upon replacement.

With reference to FIG. 6, a detailed description is provided of the holding member 72 including the roller holder 72C and the restriction member 72D. As illustrated in FIG. 6, the holding member 72 includes the roller holder 72C that rotates while holding the belt support roller 15 and the restriction member 72D including the contact surfaces 72A and 72B that contact the reference shaft 70. The restriction member 72D can be separated from the roller holder 72C at a separation position 72E. As the restriction member 72D is removed, the contact surface 72B no longer contacts the reference shaft 70, thereby allowing the roller holder 72C of the holding member 72 to rotate in the counterclockwise direction. Accordingly, the belt support roller 15 can move to the position P2 indicated by a broken line in FIG. 6. The position P2 indicated by the broken line in FIG. 6 corresponds to the position of the roller holder 72C and the belt support roller 15 shown in FIG. 7.

When the belt support roller 15 is at the position P2 as shown in FIG. 7, the intermediate transfer belt 10 is not stretched but retains slack so that the intermediate transfer belt 10 can be detached from and attached to the intermediate transfer unit 1 in the axial direction of the belt support roller 15. With this configuration, the intermediate transfer belt 10 can be replaced with ease, hence reducing a total required time for replacement of the intermediate transfer belt 10, as compared with a configuration in which the position of the belt support roller is not changeable upon replacement.

According to the present illustrative embodiment, the separation position 72E at which the restriction member 72D is separated from the roller holder 72C is substantially near the fulcrum shaft 71. In this configuration, as illustrated in FIG. 7, most of the roller holder 72C holding the belt support roller 15 is within the looped intermediate transfer belt 10 as viewed along the axial direction of the belt support roller 15 when the belt support roller 15 is moved to the position P2. It is to be noted that as long as the roller holder 72C does not hinder removal of the intermediate transfer belt 10 when the belt support roller 15 is moved to the position P2, a portion of the roller holder 72C may project beyond the looped intermediate transfer belt 10 as viewed along the axial direction of the belt support roller 15. (In FIG. 7, only a small portion of the roller holder 72C is outside the looped belt as viewed along the axial direction of the belt support roller 15.)

With this configuration, the roller holder 72C does not hinder detachment/attachment of the intermediate transfer belt 10 in the axial direction of the belt support roller 15, thereby facilitating replacement of the intermediate transfer belt 10 and preventing the intermediate transfer belt 10 from getting damaged upon replacement.

According to the present illustrative embodiment, when the belt support roller 15 is moved to the position P2, most of the roller holder 72C is within the looped intermediate transfer belt 10 as viewed along the axial direction of the belt support roller 15. Alternatively, when the belt support roller 15 is moved to the position P2, the entire roller holder 72C holding the belt support roller 15 may be positioned within the looped intermediate transfer belt 10 as viewed along the axial direction of the belt support roller 15. More specifically, by disposing the separation position 72E close to the fulcrum shaft 71 and/or forming an upper surface of the front and the back portion of the roller holder 72 relative to the separation position 72E low, the roller holder 72C holding the belt support roller 15 can be within the looped intermediate transfer belt 10 as viewed along the axial direction thereof. With this configuration, the roller holder 72C does not hinder detachment/attachment of the intermediate transfer belt 10, thereby facilitating replacement of the intermediate transfer belt 10 and preventing the intermediate transfer belt 10 from getting damaged.

With reference to FIG. 8, a description is provided of the holding member 72 according to another illustrative embodiment of the present invention. FIG. 8 is an enlarged view schematically illustrating another example of the holding member 72. In FIG. 8, the restriction member 72D that can be separated from the roller holder 72C includes the lower contact surface 72B that contacts the reference shaft 70. In other words, the restriction member 72D that can be separated from the roller holder 72C may constitute the lower contact surface 72B that contacts the reference shaft 70 during the monochrome or the single color mode. By removing the restriction member 72D including the lower contact surface 72B, the holding member 72 can turn to the position P2 in the counterclockwise direction while rotation in the clockwise direction is restricted, that is, the contact surface 72A contacts the reference shaft 70.

As illustrated in FIG. 9, as the belt support roller 15 held by the holding member 72 moves to the position P2, the intermediate transfer belt 1 is not stretched but retains slack so that the intermediate transfer belt 1 can become detachable in the axial direction of the belt support roller 15.

According to the present illustrative embodiment, the roller holder 72C includes the contact surface 72A that contacts the reference shaft 70 during the multiple color mode as compared with FIGS. 6 and 7 in which the restriction member 72D includes the contact surface 72A. As a result, when the belt support roller 15 is at the position P2, the portion of the roller holder 72C having the contact surface 72A projects beyond the area of the looped intermediate transfer belt 10 as viewed along the belt support roller 15. Therefore, as compared with the configuration shown in FIGS. 6 and 7, detachability of the intermediate transfer belt 10 upon replacement is reduced slightly, but the contact surface 72A that contacts the reference shaft 70 during the multiple color mode is integrally formed with the roller holder 72C so that the positional accuracy during the multiple color mode is enhanced. With this configuration, shifting and fluctuation of the moving speed of the intermediate transfer belt 10 can be suppressed, if not prevented entirely, during the multiple color mode in which color drift easily occurs.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a plurality of image bearing members to bear toner images of different colors on respective surfaces thereof;

a plurality of toner image forming devices to form the toner images on the respective surfaces of the plurality of image bearing members; and a transfer unit including an intermediate transfer belt, to transfer the toner images on the respective surfaces of the plurality of image bearing members onto the intermediate transfer belt, the transfer unit including a plurality of rollers, the intermediate transfer belt disposed facing the plurality of image bearing members, entrained about the plurality of rollers and formed into a loop, a reference shaft to position the transfer unit in place, a frame to hold the plurality of rollers a certain distance from the reference shaft, and a moving device including a holding member to hold one of the rollers relative to the frame, the holding member being rotatably supported by at least one fulcrum shaft that is separate from the reference shaft, wherein a recessed portion in the holding member includes a first contact surface and a second contact surface, wherein the holding member changes the position of the one of the rollers between a multiple color mode for forming a multiple color image and a single color mode for forming a single color image, wherein in the multiple color mode the first contact surface of the holding member contacts the reference shaft and the intermediate transfer belt contacts the image bearing members, wherein in the single color mode the second contact surface of the holding member contacts the reference shaft and the intermediate transfer belt separates from at least one the image bearing members, wherein the holding member comprises a restriction member and a roller holder to hold the one of the rollers, wherein the restriction member is detachably attachable relative to the roller holder, wherein when the restriction member is detached from the roller holder and the one of the rollers is moved to a first position, the intermediate transfer belt retains slack and is detachable from the transfer unit, and when the restriction member is attached to the roller holder, the holding member contacts the reference shaft to restrict movement of the holding member.

2. The image forming apparatus according to claim 1, wherein the restriction member is removed from the holding member and the roller holder holding the one of the rollers is positioned within the loop formed by the intermediate transfer belt as viewed along the axial direction.

3. The image forming apparatus according to claim 1, wherein the reference shaft of the transfer unit extends in a same direction as a direction of a shaft of the one of the rollers, and wherein the reference shaft supports the frame of the transfer unit substantially at each end of the shaft.

4. The image forming apparatus according to claim 1, wherein the holding member contacts a surface of the reference shaft outside the frame along the axial direction.

5. An image forming apparatus, comprising:

a plurality of image bearing members to bear toner images of different colors on respective surfaces thereof;

a plurality of toner image forming devices to form the toner images on the respective surfaces of the plurality of image bearing members; and a transfer unit including an intermediate transfer belt, to transfer the toner images on the respective surfaces of the plurality of image bearing members onto the intermediate transfer belt, the transfer unit including a plurality of rollers, the intermediate transfer belt disposed facing the plurality of image bearing members, entrained about the plurality of rollers, and formed into a loop, a reference shaft to position the transfer unit in place, a frame to hold the plurality of rollers a certain distance from the reference shaft, and a moving device including a holding member to hold one of the rollers relative to the frame, the holding member being rotatably supported by at least one fulcrum shaft that is separate from the reference shaft, wherein the holding member changes the position of the one of the rollers between a multiple color mode for forming a multiple color image and a single color mode for forming a single color image so that the intermediate transfer belt contacts and separates from the image bearing member, wherein a recessed portion in the holding member includes a first contact portion and a second contact portion, wherein the first contact portion of the holding member contacts the reference shaft and the roller moves to a first position such that the intermediate transfer belt contacts the image bearing members, wherein the second contact portion of the holding member contacts the reference shaft and the roller moves to a second position such that the intermediate transfer belt separates from at least one of the image bearing members, wherein the holding member comprises a restriction Member and a roller holder to hold the one of the rollers, wherein the restriction member is detachably attachable relative to the roller holder, wherein when the restriction member is detached from the roller holder and the one of the rollers is moved to a first position, the intermediate transfer belt retains slack and is detachable from the transfer unit, and when the restriction member is attached to the roller holder, the holding member contacts the reference shaft to restrict movement of the holding member.

6. The image forming apparatus according to claim 5, wherein the restriction member is removed from the holding member, the roller holder holding the one of the rollers is positioned within the loop formed by the intermediate transfer belt as viewed along the axial direction.

7. The image forming apparatus according to claim 5, wherein the reference shaft of the transfer unit extends in a same direction as a direction of a shaft of the one of the rollers, and wherein the reference shaft supports the frame of the transfer unit substantially at each end of the shaft.

8. The image forming apparatus according to claim 5, wherein the first and the second contact portions of the holding member contact a surface of the reference shaft and are positioned outside the frame along the axial direction.

9. The image forming apparatus according to claim 1, wherein the holding member rotates about a first axis parallel to an axial direction of the plurality of rollers, and wherein the restriction member moves linearly along a direction perpendicular to the first axis and restricts a rotational movement of the holding member.

10. The image forming apparatus according to claim 5, wherein the holding member rotates about a first axis parallel to an axial direction of the plurality of rollers, and wherein the restriction member moves linearly along a direction perpendicular to the first axis and restricts a rotational movement of the holding member.

11. The image forming apparatus according to claim 9, wherein the moving device includes a cam that rotates about a second axis parallel to the axial direction and contacts the restriction member to move the restriction member along the first direction.

12. The image forming apparatus according to claim 10, wherein the moving device includes a cam that rotates about a second axis parallel to the axial direction and contacts the restriction member to move the restriction member along the first direction.

13. The image forming apparatus according to claim 1, wherein the recessed portion has a U-shape and an upper side of the recessed portion is the first contact surface and a lower side of the recessed portion is the second contact surface.

14. The image forming apparatus according to claim 1, wherein the holding member holds the one of the rollers at a first end, the recessed portion is at a second end of the holding member, and the at least one fulcrum shaft is between the first end and the second end.

15. The image forming apparatus according to claim 5, wherein the recessed portion has a U-shape and an upper side of the recessed portion is the first contact portion and a lower side of the recessed portion is the second contact portion.

* * * * *